US005223893A

United States Patent [19]

Ikemoto et al.

[11] Patent Number: 5,223,893

[45] Date of Patent: Jun. 29, 1993

[54] PROCESS CARTRIDGE DETACHABLY MOUNTABLE TO IMAGE FORMING APPARATUS

[75] Inventors: Isao Ikemoto, Kawasaki; Kazushi Watanabe, Yokohama; Tadayuki Tsuda, Kawasaki; Shinichi Sasaki, Fujisawa, all of Japan

[73] Assignee: Canon Kabushiki Kaisha, Tokyo, Japan

[21] Appl. No.: 626,553

[22] Filed: Dec. 12, 1990

[30] Foreign Application Priority Data

Dec. 15, 1989 [JP] Japan ..... 1-324090

[51] Int. Cl.[5] ..... G03G 15/00

[52] U.S. Cl. ..... 355/200; 355/211; 355/245

[58] Field of Search ..... 355/245, 200, 202, 210, 355/211, 215, 260, 289, 299

[56] References Cited

U.S. PATENT DOCUMENTS 4,708,455 11/1987 Kubota et al. .
4,809,033 2/1989 Ikemoto et al. .
4,851,960 7/1989 Nakamura et al. ..... 361/225

FOREIGN PATENT DOCUMENTS 0353975 2/1990 European Pat. Off. .
0419122 3/1991 European Pat. Off. .

*Primary Examiner*—A. T. Grimley
*Assistant Examiner*—T. Dang
*Attorney, Agent, or Firm*—Fitzpatrick, Cella, Harper & Scinto

[57] ABSTRACT

A process cartridge detachably mountable to an image forming apparatus includes an image bearing member; a developing device having a developer carrying member; a supporting device for supporting the image bearing member and the developer carrying member; a first device actable on the image bearing member; a second device actable on the developer carrying member; wherein the image bearing member and the developer carrying member are urged toward each other by the first and second devices.

38 Claims, 5 Drawing Sheets

PROCESS CARTRIDGE DETACHABLY MOUNTABLE TO IMAGE FORMING APPARATUS

FIELD OF THE INVENTION AND RELATED ART

The present invention relates to an image forming apparatus such as a copying machine or printer using an electrophotographic process or an electrostatic recording process, more particularly to a process cartridge detachably mountable to such an image forming apparatus.

Such a process cartridge is constituted as a unit containing process means such as an image bearing member or a developing device, the process cartridge is detachably mountable to a main assembly of an image forming apparatus.

A developing device is known which comprises a developer carrying member in the form of a developing sleeve made of non-magnetic material and a magnet roller therein wherein the developer is conveyed to a developing zone by the speed difference therebetween.

In such a developing device, the gap between the developing sleeve surface and the image bearing member surface is required to be accurately maintained so as to effect proper developing action.

Therefore, in the conventional process cartridge, the casing is divided into a first casing for fixing the image bearing member and a second casing for fixing the developing sleeve. A thin spacer roller is interposed between the surfaces of the developing sleeve and the image bearing member adjacent opposite ends to maintain the constant gap. The first and second casings are pressed to each other by a spring means.

However, in the conventional structure, the urging means such as the spring means is required. Therefore, the structure of the process cartridge is complicated.

In addition, the process cartridge having plural casings made of precise resin mold members, are costly.

Since the spacer roller is disposed relatively close to the developing zone of the developing sleeve, the developer is deposited on a part of the surface of the spacer roller by the scattering of the developer from the developing zone which occurs in normal conditions. The ga between the developing sleeve and the image bearing member which should be constant becomes non-constant by the rotation of the spacer roller. If this occurs the image contains alternating dark and light developed portions in the form of stripes, and therefore, the image quality is degraded.

SUMMARY OF THE INVENTION

Accordingly, it is a principal object of the present invention to provide a process cartridge wherein the positional relationship between the image bearing member and a developer carrying member can be maintained by a simple structure to maintain high quality of the images.

It is another object of the present invention to provide a process cartridge having a simplified structure and having a small size with reduced cost.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
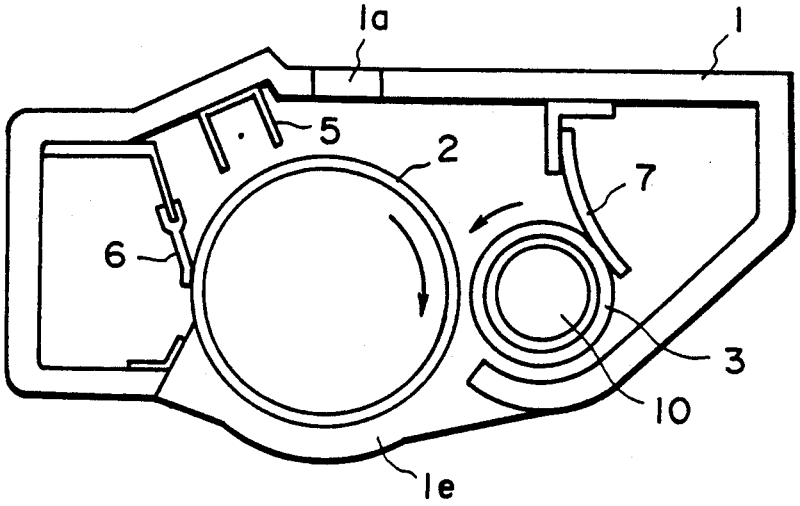
FIG. 1 is a longitudinal sectional view of a process cartridge according to a first embodiment of the present invention.
Figure 2:
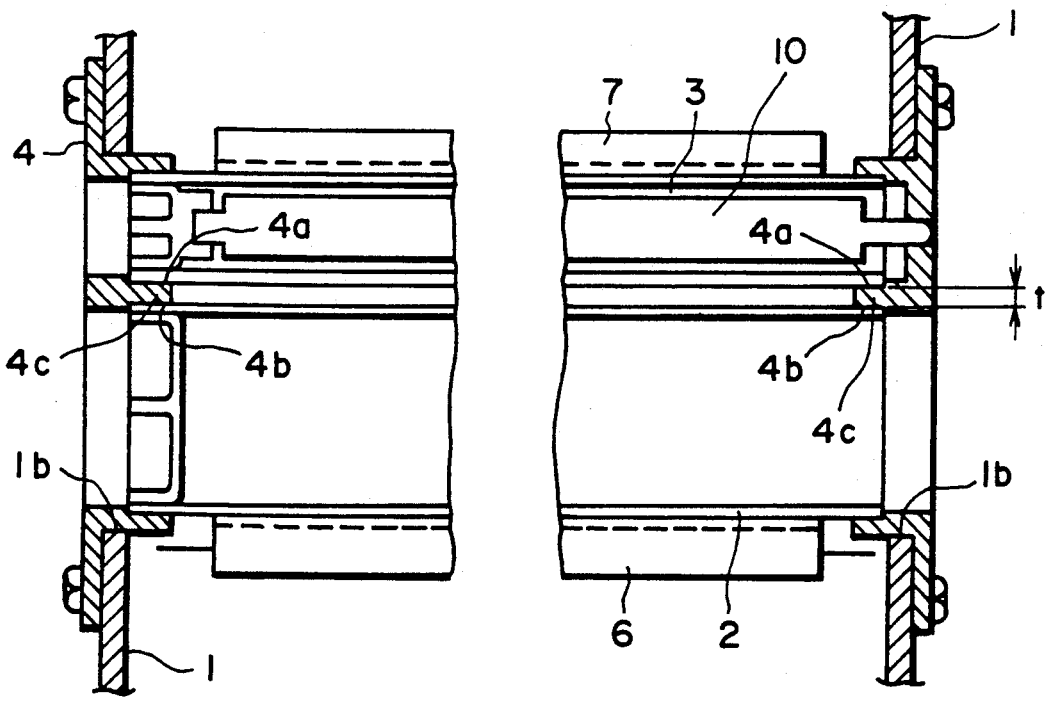
FIG. 2 is a sectional view of a major part of the process cartridge.
Figure 3:
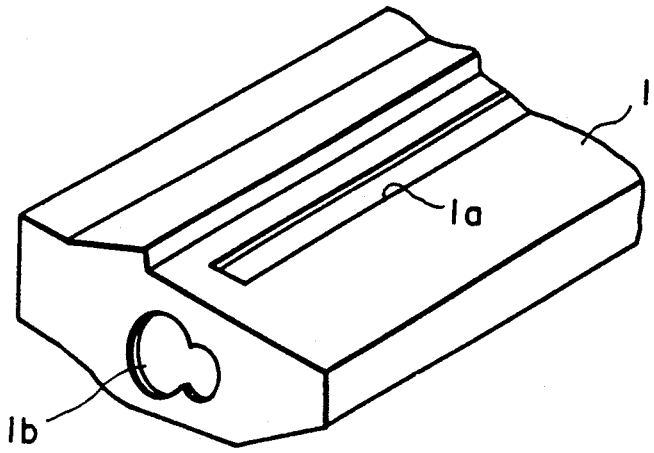
FIG. 3 is a partial perspective view of an outer appearance of the process cartridge.

Referring to FIGS. 1–3, the description will be made as to the process cartridge according to a first embodiment of the present invention. The casing 1 of the process cartridge is produced by integral molding with resin material and is provided with an elongated opening 1*a* extending in a direction of a width thereof in the top surface to permit image exposure. In side walls, there are formed openings 1*b* (FIG. 3) for receiving bearings 4 (FIG. 2) for rotatably supporting an image bearing member in the form of a photosensitive drum 2 and a developer carrying member in the form of a developing sleeve 3. As shown in FIG. 1, in a bottom wall of the casing 1, an opening 1*e* to be formed to permit transfer means is faced therethrough to the photosensitive drum 2, when the process cartridge is mounted in the image forming apparatus.

The photosensitive drum 2 and the developing sleeve 3 are both supported on the bearings 4 peripheral surfaces adjacent opposite ends of a cylinder constituting a base of the photosensitive drum 2 and a cylinder constituting a base of the developing sleeve, are supported by the bearings 4, in the manner disclosed in U.S. Ser. No. 580,563 which has been assigned to the assignee of this application. The photosensitive drum 2 has a photoconductive semiconductor surface layer made of organic semiconductor. The photosensitive drum 2 is rotated in the direction indicated by an arrow in FIG. 1. Around the photosensitive drum 2, there are disposed a charger 5, a developing sleeve 3, cleaning blade 6 press-contacted to the outer surface of the photosensitive drum 2. Thus, the photosensitive drum 2 is always urged toward the developing sleeve 3 by the cleaning blade having elasticity (rubber or the like).

To the outer periphery of the developing sleeve 3, a developing blade 7 is press-contacted. The developing blade 7 is made of elastic material such as rubber, phosphor bronze, stainless steel or the like. The developing sleeve 3 is always pressed to the photosensitive drum by the developing blade 7. The developing blade 7 cooperates with the magnet 10 in the developing sleeve 3 to regulate the layer thickness of the developer when the developer is applied on the surface of the developing sleeve, so as to make the thickness uniform. Thus, the photosensitive drum 2 and the developing sleeve 3 are urged by the cleaning blade 6 and the developing blade 7, respectively toward each other. The cleaning blade 6 and the developing blade 7 are supported on the casing 1.

Figure 7:
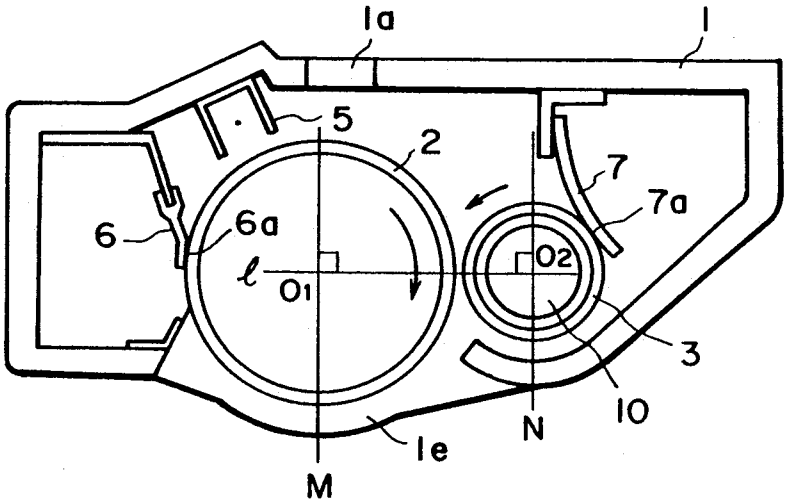
FIG. 7 is a sectional view illustrating the position where the cleaning blade and the developing blade are contacted to an image bearing member.

The urging of the photosensitive drum 2 and the developing sleeve 3 toward each other means is described as As shown in FIG. 7, a plain $l_1$ including a rotational center axis 01 of the photosensitive drum 2 and the rotational center axis 02 of the developing sleeve 3 is considered, and also plains M and N perpendicular to the plain $l_1$ passing through the axes 01 and 02 are considered. The "urging toward each other" occurs when the contact portion 6*a* between the photosensitive drum 2 and the cleaning blade 6 is on the outer periphery of the photosensitive drum 2 at a side opposite from the developing sleeve relative to the plain M, and the contact portion 7*a* between the developing sleeve 3 and the developing blade 7 is on the outer periphery of the developing sleeve at a side opposite from said photosensitive drum relative to the plain N, and in addition, the cleaning blade 6 and the developing blade 7 are press-contacted to the photosensitive drum 2 and the developing sleeve 3, respectively with predetermined respective pressures. In this embodiment, a line pressure of the contact between the cleaning blade 6 and the photosensitive drum 2 is 20–40 g/cm, and that between the developing blade 7 and the developing sleeve is 20–70 g/cm.

As shown in FIG. 2, the bearing member 4 has an opening 4*a* for receiving the developing sleeve 3 and an opening 4*b* for receiving the photosensitive drum 2. The portion 4*c* between the openings has a thickness t. Since the photosensitive drum 2 and the developing sleeve 3 are urged toward each other by the cleaning blade 6 and the developing blade 7, the gap between the outer peripheral surface of the photosensitive drum 2 and that of the developing sleeve 3 is maintained always to be equal to the thickness t (100–500 microns, for example) with precision without influence plays between the bearing 4 and the photosensitive drum 2 and between the bearing 4 and the developing sleeve 3 and without influence of the whirling of the outer peripheral surface.

Absent the pressure between the photosensitive drum 2 and the developing sleeve 3 by the cleaning blade 6 and the developing blade 7, the play between the photosensitive drum 2 and the developing sleeve 3 relative to the bearing 4 is approximately 0.07 mm at maximum, and therefore, the possible error in the gap between the photosensitive drum 2 and the developing sleeve 3 is 0.14 mm at maximum. In addition to the error, the error attributable from the whirling motion of the outer peripheries of the photosensitive drum 2 and the developing sleeve 3 are added to the error, so that the image quality is influenced.

According to this embodiment, even if the casing 1 is integrally molded, and even if the urging means such as a spring particularly for urging the developing sleeve 3 toward the photosensitive drum 2 is omitted, the gap between the photosensitive drum 2 and the developing sleeve can be maintained precisely to be "t". Therefore, the structure of the process cartridge can be simplified, and the size and the cost thereof can be reduced.

Additionally, the necessity for the spacer roller required in the prior art can be eliminated, and therefore, the degradation of the image quality attributable to the contamination of the spacer rollers due to the scattering of the developer can be eliminated, so that the high quality of the image can be stably provided.

Figure 8:
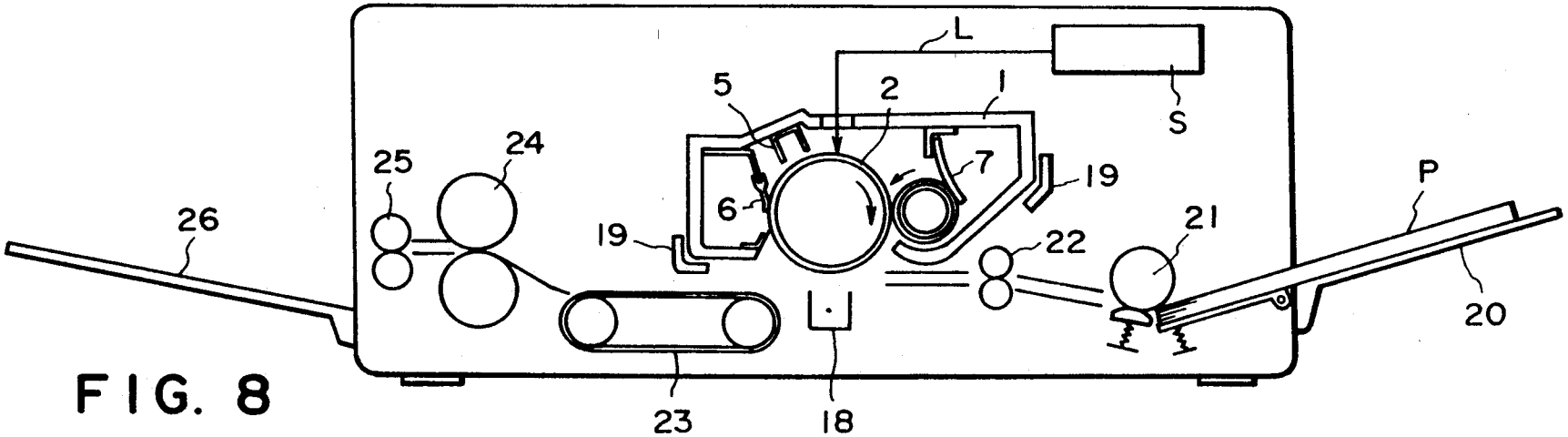
FIG. 8 is a sectional view of an image forming apparatus to which the process cartridge is mounted.
Figure 9:
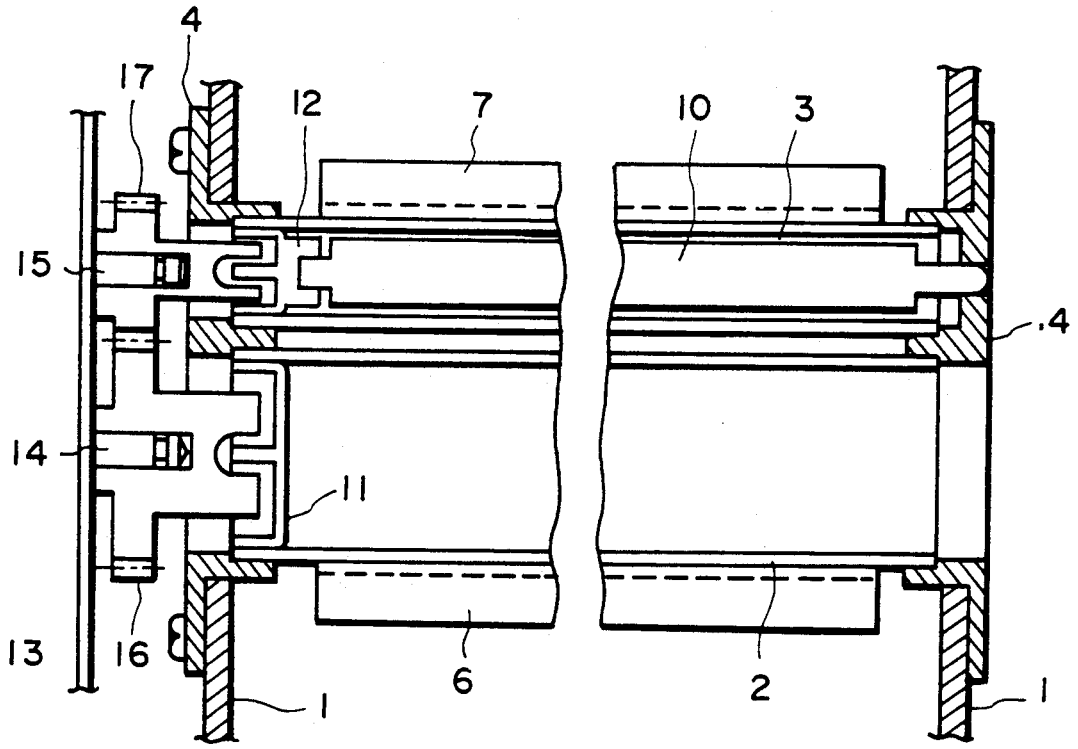
FIG. 9 is a sectional view of a drive transmitting section between the photosensitive drum and the developing sleeve when the process cartridges mounted thereto.

FIG. 8 shows an image forming apparatus in the form of a laser beam printer incorporating the process cartridge shown in FIGS. 1–3. FIG. 9 shows a drive transmission system between the photosensitive drum and the developing sleeve in the process cartridge.

As shown in FIG. 9, shafts 14 and 15 projected from the main assembly 13 of the laser beam printer have driving gears 16 and 17 rotatably mounted thereto and meshed with each other. When the process cartridge is mounted to the main assembly 13, the driving gears 16 and 17 are engaged with a flange 11 of the photosensitive drum 2 and engaged with a flange 12 of the developing sleeve 3, as shown in the Figure. Therefore, the photosensitive drum 2 and the developing sleeve 3 receive the driving force through the driving gears 16 and 17 from an unshown driving motor so as to rotate in the respective directions indicated by arrows in FIG. 8.

The description will be made as to the image forming operation in the laser beam printer having the process cartridge mounted thereto. The photosensitive drum 2 is uniformly charged by a charger and is exposed to image light L modulated in accordance with an image signal by a laser beam scanner S, so that an electrostatic latent image is formed in accordance with the image signal. The latent image is developed by the developer on the developing sleeve 3.

A sheet P of paper, for example, accommodating a sheet feed tray 20 is picked up by a pickup roller 21 and is once stopped by a pair of registration rollers 22. The registration rollers 22 feed the sheet P in timed relation with a developed image on the photosensitive drum 2. Onto the sheet P, the developed image is transferred from the photosensitive drum by a transfer charger 18. The sheet P after receiving the image is conveyed along a conveying guide 23 to an image fixing device, where it is subjected to the image fixing operation so that the toner image is fixed on the sheet P. The sheet P is discharged by discharging rollers 25 onto the discharge tray 26.

The developer remaining on the photosensitive drum 2 surface after the image transfer is removed by a cleaning member 6, so that the photosensitive drum 2 is prepared for the next image formation.

In FIG. 8, designated by a reference numeral 19 is a guiding member for guiding the mounting and dismounting of the process cartridge. In this embodiment, the process cartridge is mounted or dismounted in the direction of the axis of the photosensitive drum 2 relative to the laser beam printer.

In this embodiment, the transfer charger is in the form of a corona discharger, but it may be a transfer roller supplied with a bias voltage.

Figure 4:
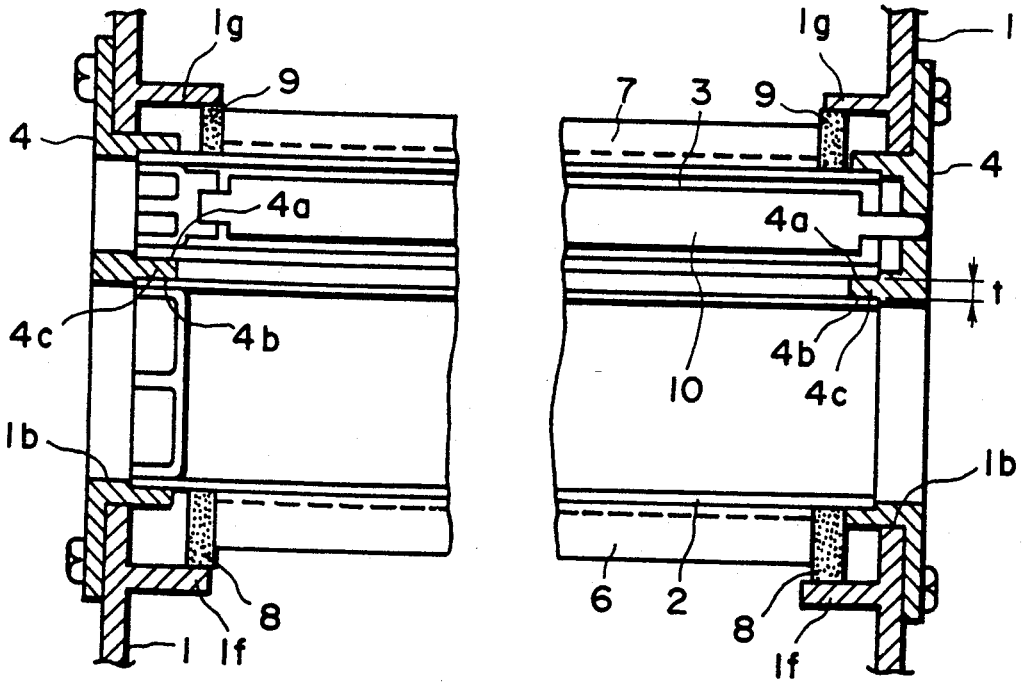
FIG. 4 is a cross-sectional view of a major part of a process cartridge according to a second embodiment of the present invention.

Referring to FIG. 4, the second embodiment of the present invention will be described. In FIG. 4, the same reference numerals as in FIGS. 1–3 are assigned to the elements having the corresponding functions.

In the embodiment of FIG. 4, drum end sealing members 8 and sleeve end sealing members 9 are employed to seal the photosensitive drum 2 and the developing sleeve 3 at the longitudinal opposite ends. At least the surfaces contacted to the photosensitive drum 2 and the sleeve surface 3 are made of felt or smooth surface sheet material, and the base portion thereof is made of elastic material such as foamed rubber. The sealing members are effective to prevent the developer from scattering through the end portions.

The drum end seal 8 is sandwiched between an outer surface of the photosensitive drum 2 and a part 1*f* of the casing, and the sleeve end seal, is sandwiched between the surface of the developing sleeve 3 and a part 1*c* of the casing.

The drum end seal 8 urges the photosensitive drum 2 to the developing sleeve 3, and the sleeve end seal 9 urges the developing sleeve 3 to the photosensitive drum 2. Therefore, the gap between the photosensitive drum 2 and the developing sleeve 3 is maintained to be equal to the thickness t of the portion 4*c* of the bearing 4. The same advantageous effects as in the first embodiment can be provided. Particularly, in this embodiment the urging forces by the sealing members are applied in addition to the urging force by the cleaning blade 6 and the developing blade 7. Therefore, this embodiment is further preferable in this respect.

In this embodiment, the contact positions between the end seals and the photosensitive drum and between the end seals and developing sleeve are the same as in the first embodiment, and the seal are disposed in a non-image formation area.

Figure 5:
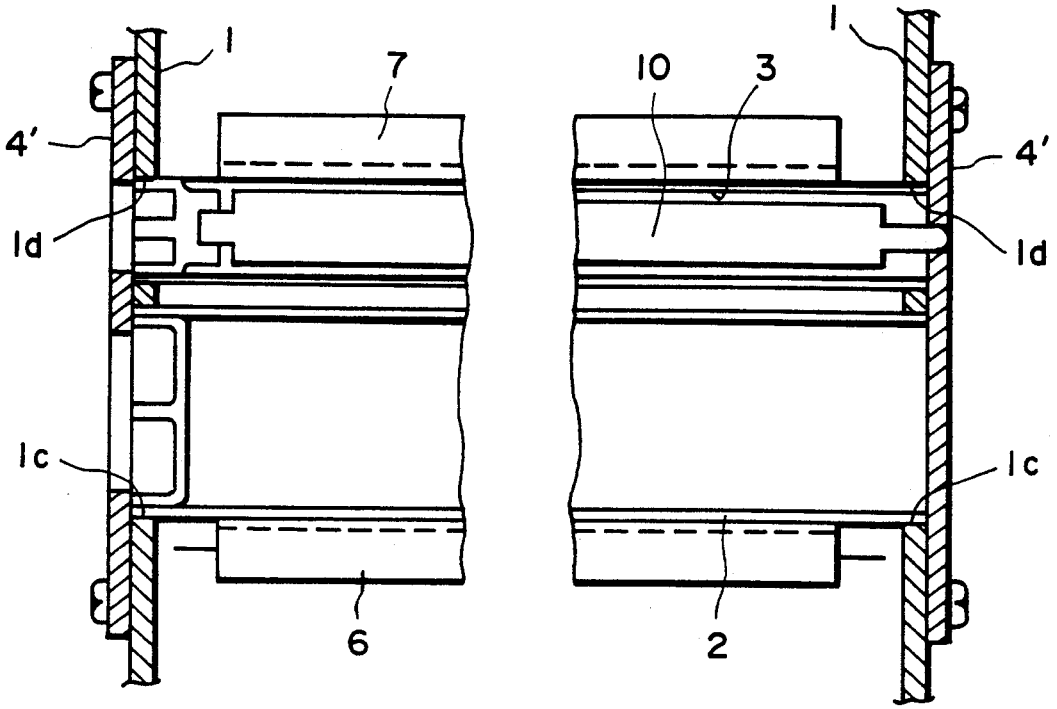
FIG. 5 is a cross-sectional view of a major part of the process cartridge according to a third embodiment of the present invention.
Figure 6:
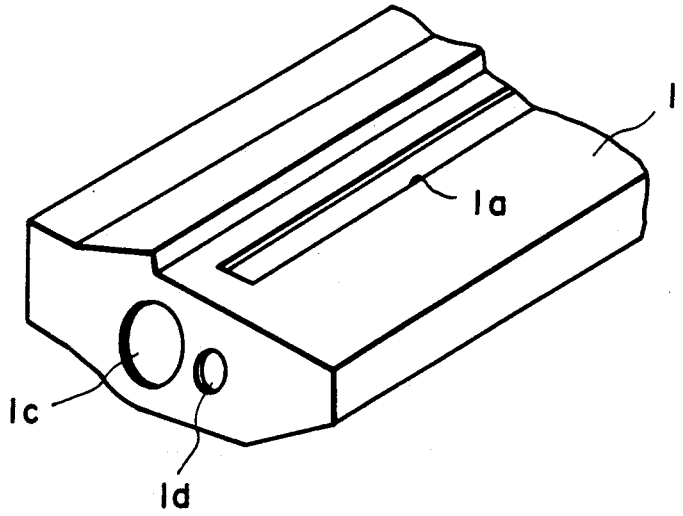
FIG. 6 is a partial perspective view of an outer appearance of a casing of the process cartridge of FIG. 5.

Referring to FIGS. 5 and 6, a third embodiment will be described. In the first and second embodiments, the bearing 4 supports the photosensitive drum 2 and the developing sleeve 3, and is mounted in the casing or frame 1. In the present embodiment, however, openings 1*c* and 1*d* are formed in the casing 1, and the photosensitive drum 2 and the developing sleeve 3 are rotatably supported directly in the openings 1*c* and 1*d* without use of separate bearing 4. End surfaces of the photosensitive drum 2 and the developing sleeve 3 are abutted by stoppers 4' to limit the movement of the photosensitive drum 2 and the developing sleeve 3 in the longitudinal direction. In this embodiment, the casing 1 functions as a supporting means for the photosensitive drum 2 and the developing sleeve 3.

The same advantageous effects as in the first and second embodiments are provided.

In the first, second and third embodiments, what determines the gap between the photosensitive drum 2 and the developing sleeve 3 is a part of the casing or frame 1, or the portion 4*c* of the bearing 4. This is not limiting. In place thereof, a spacer sheet made of high density polyethylene, nylon, polyacetal or the like usable as the image bearing member 4 may be sandwiched therebetween.

As regards the positional relation between the photosensitive drum and the developing roller, the gap therebetween is inevitable. For example, in the developing system wherein the developing roller is in contact with the photosensitive drum, the present invention is still usable to assure the correct contact pressure therebetween.

The means for acting on the image bearing member (photosensitive drum) is not limited to those described in the foregoing. Alternatively, it may be a charging roller or a charging blade contacted to the photosensitive drum to effect the charging process, as disclosed in U.S. Pat. No. 4,851,960, for example.

The means actable on the developer carrying member (developing sleeve) is not limited to the member for regulating the developer layer thickness. It may be a supplying roller for simply supplying the developer to the developing sleeve.

In the foregoing embodiments, the cleaning member and the developer layer thickness regulating member are in the form of a blade. This is not limiting, and may be in the form of a roller.

The method of supporting the photosensitive drum or the developing sleeve is not limited to the outer peripheral supporting type.

As described in the foregoing, according to the present invention, the image bearing member and the developer carrying member are urged toward each other by means such as elastic cleaning member or the like actable on the image bearing member and means actable on the developer carrying member such as elastic developer layer thickness regulating member. Therefore, the correct positioning between the image bearing member and the developer carrying member can be accomplished without the necessity of particular urging means for this purpose. In addition, the process cartridge casing or frame which is required to have high precision can be integrally molded, so that the structure of the process cartridge is simplified, and the size and the cost can be reduced.

It is possible to avoid use of the spacer roller, and in that case, the degradation of the image quality attributable to the contamination of the spacer roller can be avoided. Therefore, good images can be stably provided.

While the invention has been described with reference to the structures disclosed herein, it is not confined to the details set forth and this application is intended to cover such modifications or changes as may come within the purposes of the improvements or the scope of the following claims.

What is claimed is:

1. A process cartridge detachably mountable to a main assembly of an image forming apparatus, comprising:

an image bearing member;

developing means having a developer carrying member for carrying a developer;

a supporting member for supporting said image bearing member and said developer carrying member for relative movement toward each other;

a cleaning member elastically pressed to said image bearing member to remove residual developer from said image bearing member; and a regulating member, elastically pressed to said developer carrying member, for regulating a layer of the developer formed on said developer carrying member, wherein said image bearing member and said developer carrying member are pressed toward each other by said cleaning member and said regulating member.

2. A process cartridge according to claim 1, wherein said first means includes an elastic cleaning member.

3. A process cartridge according to claim 2, wherein said cleaning member includes a rubber blade.

4. A process cartridge according to claim 1 or 2, wherein said second means includes an elastic member for regulating a thickness of a layer of the developer on said developer carrying member.

5. A process cartridge according to claim 4, wherein said regulating member includes a rubber blade.

6. A process cartridge according to claim 1, wherein said image bearing member and said developer carrying member each include a cylindrical member, and said supporting means supports an outer peripheral surface of the cylindrical member.

7. A process cartridge according to claim 6, wherein said supporting member includes a spacer for maintaining a predetermined gap between said image bearing member and said developer carrying member.

8. A process cartridge according to claim 1 or 2; wherein said first means and second means each include a sealing member actable on said image bearing member and said developer carrying member at end portions thereof.

9. A process cartridge according to claim 8, wherein said sealing members are sandwiched between said image bearing member and a casing of said process cartridge and between said developer carrying member and the casing, respectively.

10. A process cartridge according to claim 8, wherein said sealing member functions to prevent the developer from scattering.

11. A process cartridge according to claim 1 or 6, wherein said supporting means functions also as a casing for the process cartridge.

12. A process cartridge according to claim 11, wherein the casing is integrally molded with resin material.

13. A process cartridge according to claim 1, wherein said first and second means are supported by a casing of the process cartridge.

14. A process cartridge according to claim 13, wherein the casing is integrally molded with resin material.

15. A process cartridge according to claim 1, wherein said first means is process means actable on said image bearing member.

16. A process cartridge according to claim 1, wherein said urging occurs by means of a first contact portion between said image bearing member and said first actable means, said first contact portion being on an outer periphery of said image bearing member at a side opposite from said developer carrying member relative to a plane M, and by a second contact portion between said developer carrying member and said second actable means, said second contact portion being on an outer periphery of said developer carrying member at a side opposite from said image bearing member relative to a plane N and also by said first actable means and said second actable means being press-contacted to said image bearing member and said developer carrying member, respectively, with predetermined respective pressures, where planes M and N are planes perpendicular to a plane L and passing through rotational center axes of said image bearing member and said developer carrying member, respectively, where L is a plane including the axes of said image bearing member and said developer carrying member.

17. A process cartridge according to claim 1, wherein said first means comprises a cleaning blade, and said second means comprises a developing blade, wherein said image bearing member is in the form of a photosensitive drum, and said photosensitive drum and said developer carrying member are urged by said cleaning blade and said developing blade, respectively, in directions toward each other.

18. A process cartridge detachably mountable to an image forming apparatus, comprising:

an image bearing member;

developing means having a developer carrying member for carrying a developer;

supporting means for supporting said image bearing member and said developer carrying member such that said image bearing member is free to move relative to said developer carrying member;

first means actable on said image bearing member; and second means actable on said developer carrying member;

wherein said image bearing member and said developer carrying member are urged toward each other by said first means and said second means; and wherein said first means comprises a cleaning blade, and said second means comprises a developing blade, wherein said image bearing member is in the form of a photosensitive drum, and said cleaning blade urges the photosensitive drum at a line pressure in the range of 20–40 g/cm, and said developing blade urges said developer carrying member at a line pressure in the range of 20–70 g/cm.

19. A process cartridge according to claim 1, wherein said image bearing member is movable relative to said supporting means with a predetermined amount of play.

20. A process cartridge detachably mountable to an image forming apparatus, comprising:

am image bearing member;

developing means having a developer carrying member for carrying a developer;

supporting means for supporting said image bearing member and said developer carrying member such that said image bearing member is free to move relative to said developer carrying member;

first means actable on said image bearing member; and second means actable on said developer carrying member;

wherein said image bearing member and said developer carrying member are urged toward each other by said first means and said second means;

wherein said image bearing member is movable relative to said supporting means with a predetermined amount of play; and wherein the amount of play is approximately 0.07 mm.

21. A process cartridge detachably mountable to an image forming apparatus, comprising:

an image bearing member;

developing means having a developer carrying member for carrying a developer;

supporting means for supporting said image bearing member and said developer carrying member such that said image bearing member is free to move relative to said developer carrying member;

first means actable on said image bearing member; and second means actable on said developer carrying member;

wherein said image bearing member and said developer carrying member are urged toward each other by said first means and said second means; and wherein said developer carrying member is spaced apart from said image bearing member in the range of 100–500 microns.

22. An image forming apparatus, comprising:

an image bearing member;

developing means having a developer carry member for carrying a developer;

supporting means for supporting said image bearing member and said developer carrying member such that said image bearing member is free to move relative to said developer carrying member;

first means actable on said image bearing member; and second means actable on said developer carrying member;

wherein said image bearing member and said developer carrying member are urged toward each other by said first means and said second means;

wherein said image bearing member and said developer carrying member each include a cylindrical member, and said supporting means supports an outer peripheral surface of the cylindrical member;

wherein said supporting member includes a spacer for maintaining a predetermined gap between said image bearing member and said developer carrying member; and further comprising transfer means for transferring an image from said image bearing member to a recording material and fixing means for fixing the image on the recording material.

23. An image forming apparatus, comprising:

mounting means for mounting a process cartridge, wherein said process cartridge includes an image bearing member;

developing means having a developer carrying member for carrying a developer;

a supporting member for supporting said image bearing member and said developer carrying member for relative movement toward each other;

a cleaning member elastically pressed to said image bearing member to remove residual developer from said image bearing member; and a regulating member, elastically pressed to said developer carrying member, for regulating a layer of the developer formed on said developer carrying member, wherein said image bearing member and said developer carrying member are pressed toward each other by said cleaning member and said regulating member; and conveying means for conveying a recording material on which recording is effected.

24. An image forming apparatus according to claim 23, wherein said mounting means comprises a guiding member for guiding said process cartridge.

25. An image forming apparatus according to claim 23, wherein said image forming apparatus is in the form of a copying machine.

26. An image forming apparatus according to claim 23, wherein said image forming apparatus is in the form of a printer.

27. A process cartridge according to claim 1, wherein said image bearing member is movable within a range of play in engagement with said supporting member.

28. A process cartridge according to claim 27, wherein the play is approximately 0.07.

29. A process cartridge according to claim 1, further comprising a drum end seal elastically pressed to said image bearing member to push said image bearing member toward said developer carrying member.

30. A process cartridge according to claim 1, further comprising a charging roller elastically pressed to said image bearing member to push said image bearing member toward developer carrying member.

31. A process cartridge according to claim 1, further comprising a charging blade elastically pressed to said image bearing member to push said image bearing member toward said developer carrying member.

32. A process cartridge according to claim 1, further comprising a sleeve end seal elastically pressed to said developer carrying member to push said developer carrying member toward said image bearing member, said developer carrying member comprising a sleeve.

33. A process cartridge according to claim 1, further comprising a developer supply roller for supplying the developer to said developer carrying member, said developer supply roller being elastically pressed to said developer carrying member to push said developer carrying member toward said image bearing member.

34. A process cartridge according to claim 1', wherein said image bearing member comprises a photosensitive member and said developer carrying member comprises a developing sleeve, wherein said image bearing member and said developer carrying member are spaced from each other by a spacer therebetween during an image forming operation.

35. An image forming apparatus according to claim 23, wherein said image bearing member comprises a photosensitive member and said developer carrying member comprises a developing sleeve, wherein said image bearing member and said developer carrying member are spaced from each other by a spacer therebetween during an image forming operation.

36. A process cartridge according to claim 4, wherein said first means and second means each include a sealing member actable on said image bearing member and said developer carrying member at end portions thereof.

37. A process cartridge according to claim 36, wherein said sealing members are sandwiched between said image bearing member and a casing of said process cartridge and between said developer carrying member and the casing, respectively.

38. A process cartridge according to claim 36, wherein said sealing member functions to prevent the developer from scattering.

* * * * *

UNITED STATES PATENT AND TRADEMARK OFFICE

CERTIFICATE OF CORRECTION

PATENT NO. : 5,223,893

DATED : June 29, 1993

INVENTOR(S) : ISAO IKEMOTO, ET AL.

It is certified that error appears in the above-indentified patent and that said Letters Patent is hereby corrected as shown below:

On the title page, Item

[56] References Cited

Under: "U.S. PATENT DOCUMENTS

| | | | |
|---|---|---|---|
| 4,708,455 | 11/1987 | Kubota et al. | 361/225 |
| 4,809,033 | 2/1989 | Ikemoto et al. | 361/225 |
| 4,851,960 | 7/1989 | Nakamura et al. | ....361/225" |

Insert:

| | | | |
|---|---|---|---|
| --4,951,093 | 8/1990 | Ishii et al. | .....355/245 |
| 4,893,151 | 1/1990 | Yamazaki et al. | ...355/245 |
| 4,862,209 | 8/1989 | Sakamoto et al. | ...355/211-- |

Under "FOREIGN PATENT DOCUMENTS

| | | |
|---|---|---|
| 0353975 | 2/1990 | EPA |
| 0419122 | 3/1991 | EPA |

Insert:

| | | |
|---|---|---|
| --0192769 | 8/1987 | Japan. |
| 0192770 | 8/1987 | Japan. |
| 0156686 | 7/1987 | Japan.-- |

COLUMN 1

Line 45, "ga" should read --gap--.

COLUMN 2

Line 25, "cartridges" should read --cartridge is--.

Line 42, "to be" should read --is--.

Line 43, "is" should read --to be--.

UNITED STATES PATENT AND TRADEMARK OFFICE

CERTIFICATE OF CORRECTION

PATENT NO. : 5,223,893

DATED : June 29, 1993

INVENTOR(S) : ISAO IKEMOTO, ET AL.

It is certified that error appears in the above-indentified patent and that said Letters Patent is hereby corrected as shown below:

COLUMN 3

Line 11, delete "means"--.
Line 12, "as" should read --as follows.--.
Line 13, "plain" should read --plane--.
Line 16, "plains" should read --planes--.
Line 17, "plain" should read --plane--.
Line 22, "plain" should read --plane--.
Line 26, "plain" should read --plane--.
Line 45, delete "without influence".
Line 63, "particularly" should be deleted.

COLUMN 4

Line 33, "accommodating" should read --accommodated in--.

COLUMN 5

Line 7, "seal," should read --seal 9--.
Line 25, "seal," should read --seals--.

UNITED STATES PATENT AND TRADEMARK OFFICE

CERTIFICATE OF CORRECTION

PATENT NO. : 5,223,893

DATED : June 29, 1993

INVENTOR(S) : ISAO IKEMOTO, ET AL.

It is certified that error appears in the above-indentified patent and that said Letters Patent is hereby corrected as shown below:

COLUMN 7
Line 8, "2;" should read --2,--.

COLUMN 9
Line 1, "carry" should read --carrying--.
Line 30, "includes" should read --includes:--.

COLUMN 10
Line 8, "0.07." should read --0.07 mm.--.

Signed and Sealed this

Fifth Day of July, 1994

Bruce Lehman

*Attest:*

BRUCE LEHMAN

*Attesting Officer*

*Commissioner of Patents and Trademarks*